US006988587B1

(12) United States Patent
Smith

(10) Patent No.: US 6,988,587 B1
(45) Date of Patent: Jan. 24, 2006

(54) FIRE ESCAPE DEVICE

(76) Inventor: Tony L. Smith, 11429 N. 450 East, Linden, IN (US) 47955

( * ) Notice: Subject to any disclaimer, the term of this patent is extended or adjusted under 35 U.S.C. 154(b) by 279 days.

(21) Appl. No.: 10/694,232

(22) Filed: Oct. 28, 2003

(51) Int. Cl.
*A62B 1/10* (2006.01)

(52) U.S. Cl. ..... 182/73; 182/71

(58) Field of Classification Search ..... 182/73, 182/71, 231, 236, 70, 72, 5–7
See application file for complete search history.

(56) References Cited

U.S. PATENT DOCUMENTS 654,415 A * 7/1900 Rinn ..... 182/72
750,240 A 1/1904 Brielmaier
1,303,709 A 5/1919 Miller
2,500,884 A 3/1950 Tessin
4,567,962 A * 2/1986 Kladitis ..... 182/5
4,603,759 A 8/1986 Hamada
4,679,654 A * 7/1987 Lu ..... 182/5
5,127,490 A 7/1992 Sheu
5,590,740 A 1/1997 Mai

* cited by examiner

*Primary Examiner*—Alvin Chin-Shue

(57) ABSTRACT

A fire escape device includes a housing having a top wall, a first end wall, a second end wall, a front wall and a rear wall. A spindle is rotatably mounted to and extends between the first and second end walls. A pair of gripping members each has a bottom side, an upper side, and a pair of lateral sides. The spindle extends through each of the lateral sides such that the bottom sides are positioned nearer the spindle than the upper sides. A spool with a tether is rotatably mounted on the spindle. The tether has a free end extending through an aperture in the top wall. A fastening assembly is attached to the free end for selectively attaching the free end to a dwelling. Hands positioned on the gripping member are secured within the housing by a compressing action between the gripping member and the front wall.

12 Claims, 4 Drawing Sheets

FIRE ESCAPE DEVICE

BACKGROUND OF THE INVENTION

1. Field of the Invention

The present invention relates to fire escape and rescue devices and more particularly pertains to a new fire escape and rescue device for suspending a person outside of a window dwelling.

2. Description of the Prior Art

The use of fire escape and rescue devices is known in the prior art. While these devices fulfill their respective, particular objectives and requirements, the need remains for a device that suspends a person outside of a dwelling so that they may escape a fire. Such a device should ensure that the person's hands are secured in such a manner that they will not slip away from the device.

SUMMARY OF THE INVENTION

The present invention meets the needs presented above by generally comprising a housing having a top wall, a first end wall, a second end wall, a front wall and a rear wall. The top wall has an aperture extending therethrough. A spindle is rotatably mounted to and extends between the first and second end walls. A pair of gripping members is attached to spindle. The gripping members are spaced from each other. Each of the gripping members has a bottom side, an upper side, a pair of lateral sides, a forward side and a back side. The spindle extends through each of the lateral sides such that the bottom sides are positioned nearer the spindle than the upper sides and the gripping members are aligned with each other. A spool is rotatably mounted on the spindle and is positioned between the gripping members. A tether is attached to and wound about the spool. The tether has a free end extending through the aperture. A fastening assembly is attached to the free end for selectively attaching the free end to a dwelling. Each of a pair of hands may be positioned on the gripping members and the gripping members rotated such that the hands are secured within the housing by a compressing action between the gripping member and the front wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
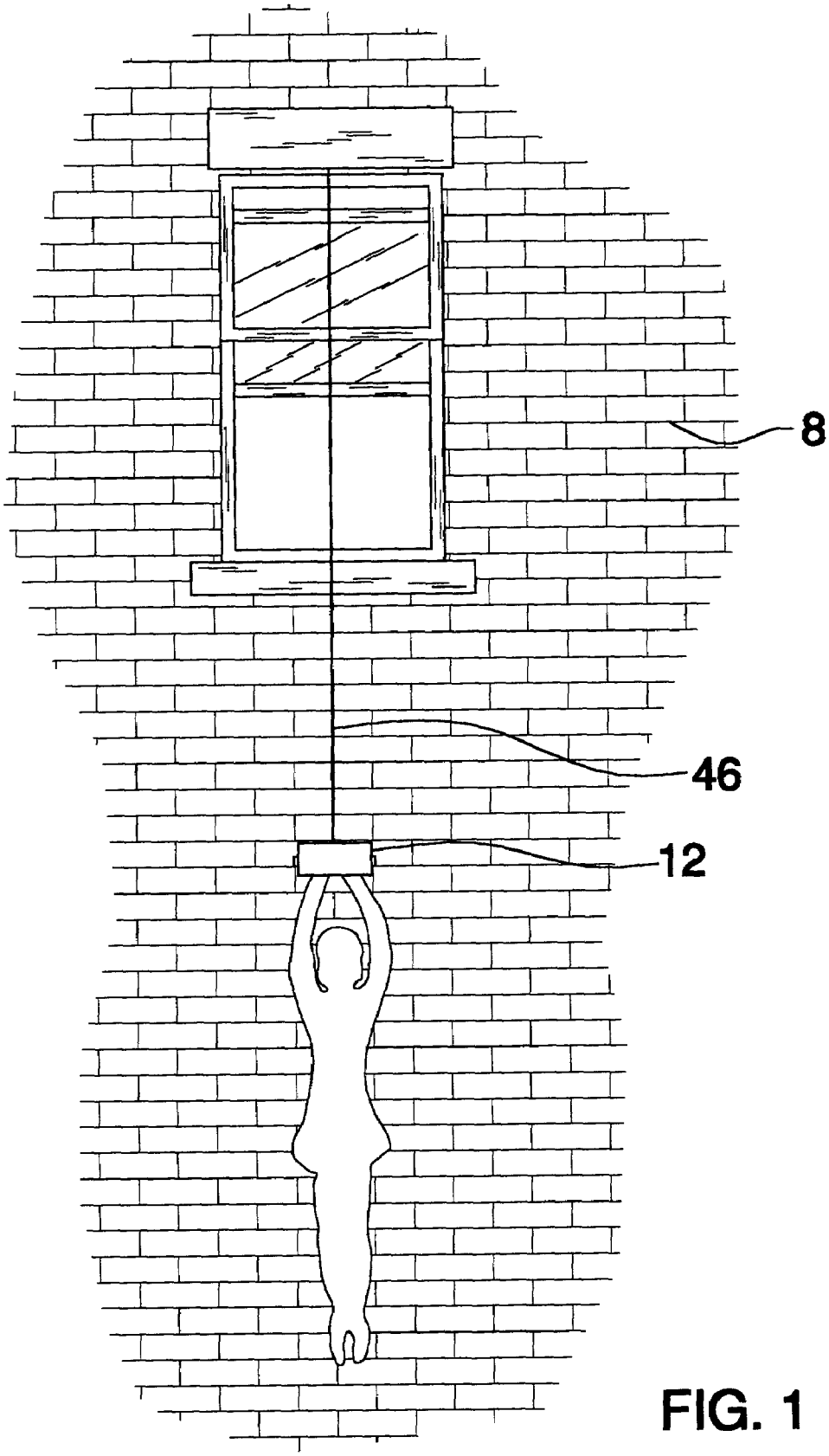
FIG. 1 is a schematic front environmental view of a fire escape device according to the present invention.
Figure 2:
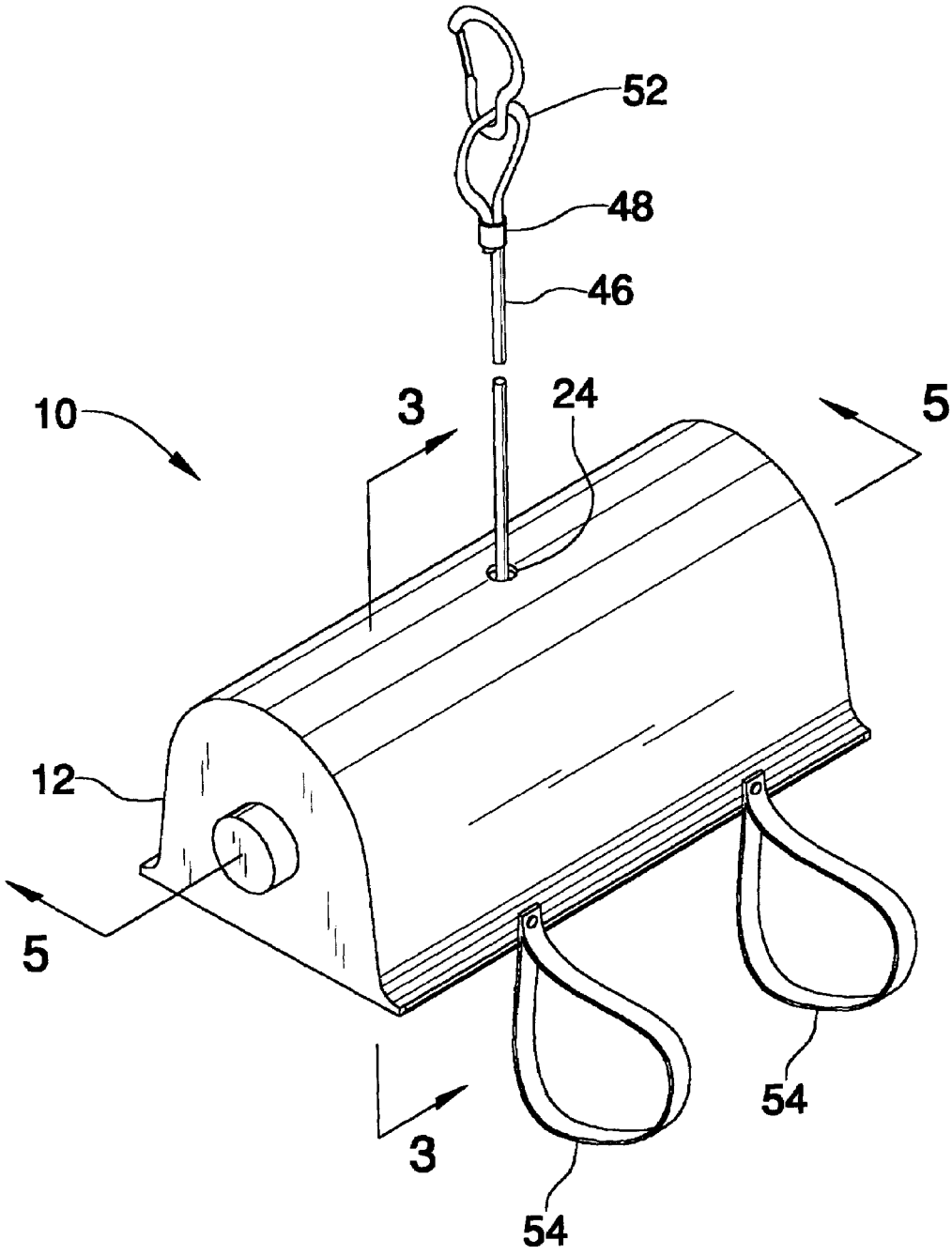
FIG. 2 is a schematic perspective view of the present invention.

With reference now to the drawings, and in particular to FIGS. 1 through 5 thereof, a new fire escape and rescue device embodying the principles and concepts of the present invention and generally designated by the reference numeral 10 will be described.

Figure 3:
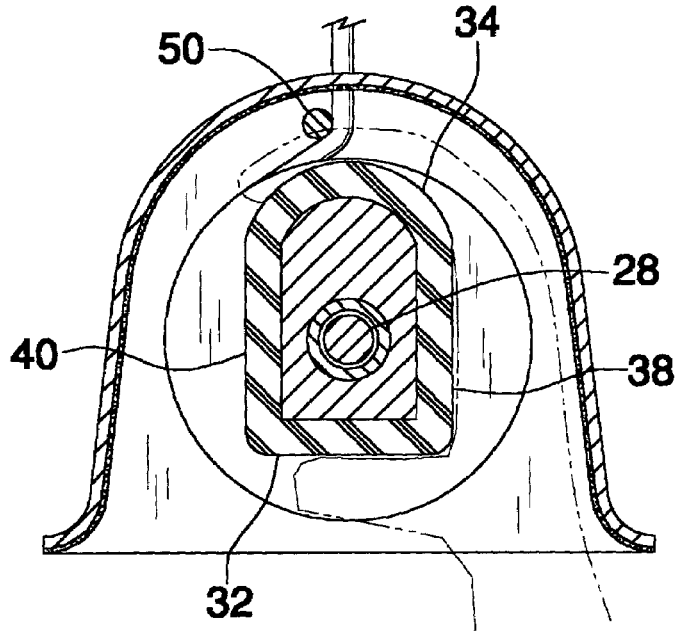
FIG. 3 is a schematic cross-sectional view taken along line 3—3 of FIG. 2 of the present invention.
Figure 4:
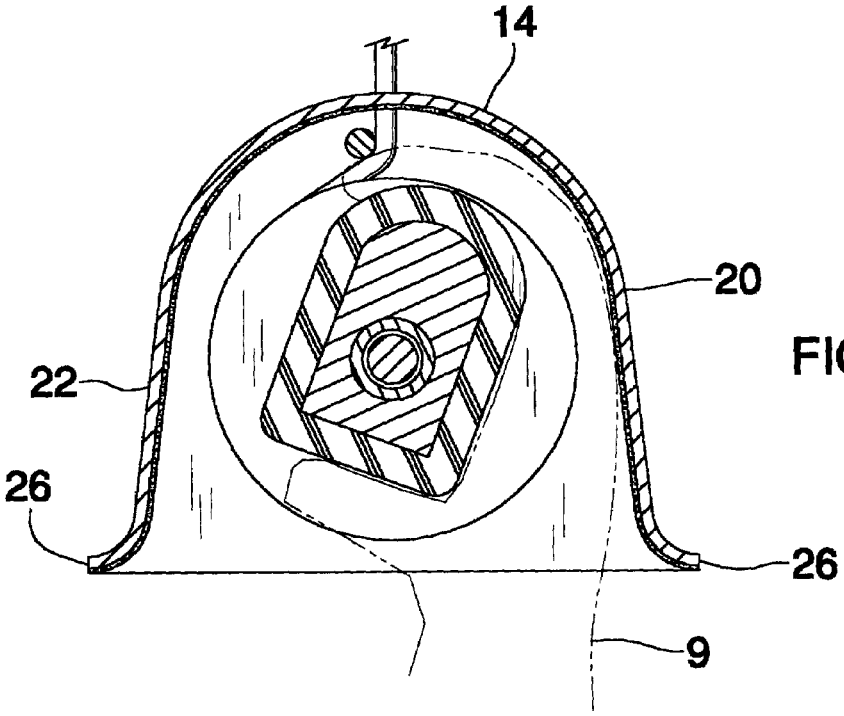
FIG. 4 is a schematic cross-sectional view of the present invention.
Figure 5:
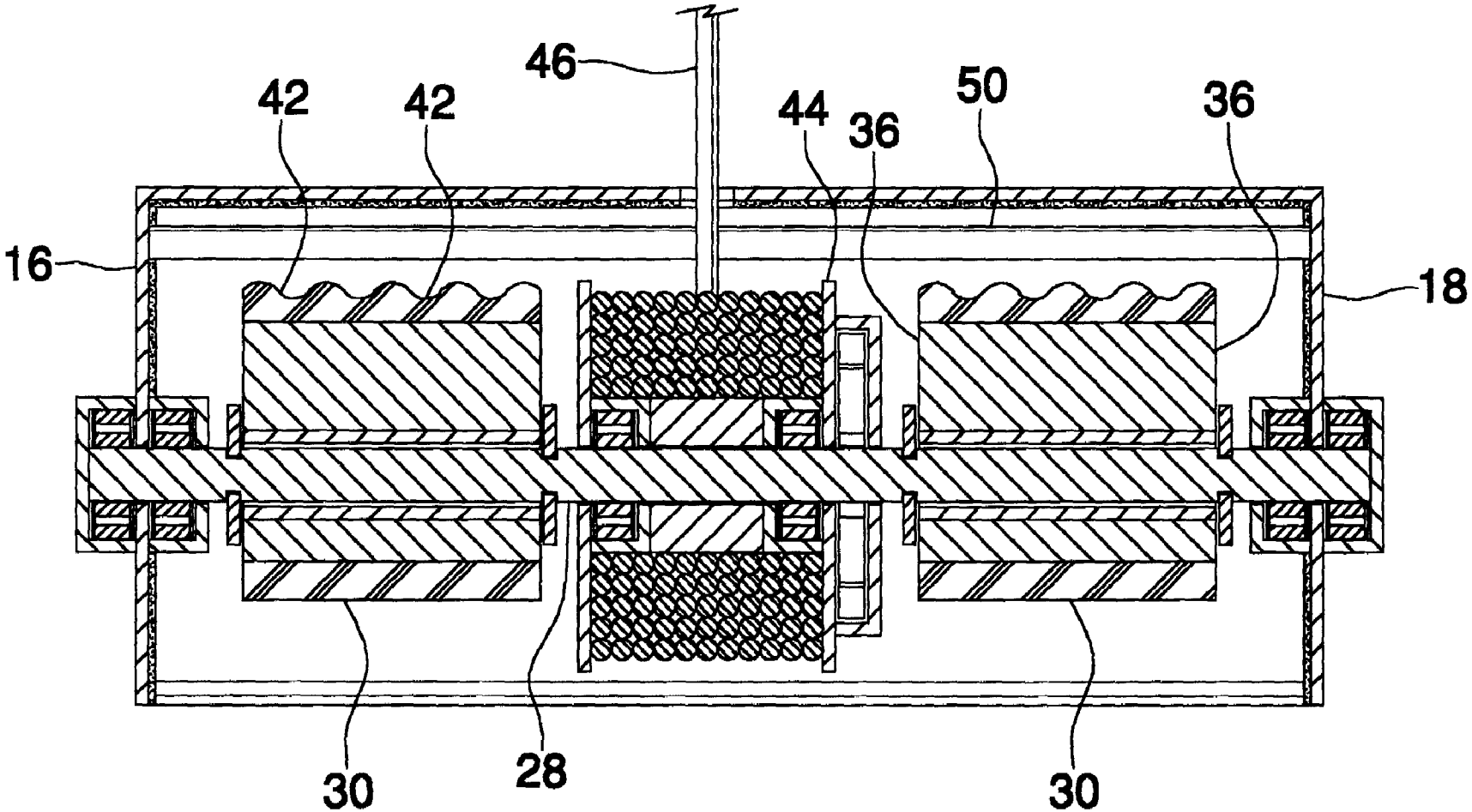
FIG. 5 is a schematic cross-sectional view taken along line 5—5 of FIG. 2 of the present invention.

As best illustrated in FIGS. 1 through 5, the fire escape device 10 generally comprises a housing 12 having a top wall 14, a first end wall 16, a second end wall 18, a front wall 20 and a rear wall 22. The top wall 14 has an aperture 24 extending therethrough. The top wall 14 is arcuate such that a cross-section of the housing 12 taken transversely to a longitudinal axis of the housing 12 has an upside down U-shape as shown in FIGS. 3 and 4. Each of the front 20 and rear 22 walls has a flared bottom edge 26. A spindle 28 is rotatably mounted to and extends between the first 16 and second 18 end walls.

Each of a pair of gripping members 30 is attached to spindle 28. The gripping members 30 are spaced from each other and each has a bottom side 32, an upper side 34, a pair of lateral sides 36, a forward side 38 and a back side 40. Each of the forward 38 and back 40 sides of the gripping members 30 is substantially planar and is parallel orientated with respect to each other. The spindle 28 extends through each of the lateral sides 36 such that the bottom sides 32 are positioned nearer the spindle 26 than the upper sides 34 and the gripping members 30 are aligned with each other. By aligned, what is meant is that the upper 34 and bottom 32 sides of each gripping member 30 continually face in the same direction. A first distance is defined between the top walls 14 and the upper surfaces 34 when the upper surfaces 34 are directed toward the top walls 14 and a second distance is defined between the front walls 20 and the upper surfaces 34 when the upper surfaces 34 are directed toward the front walls 20. The second distance is preferably less than ½ inch and more preferably less than ¼ inch. The first distance is greater than the second distance and is preferably at least 1 inch. The top sides 34 are convexly arcuate from the forward sides 38 to the rear sides 40. Each of the upper sides 34 has a plurality of aligned finger receiving indentations 42 therein extending between the lateral sides 36.

A spool 44 is rotatably mounted on the spindle 28 and is positioned between the gripping members 30. A tether 46 is attached to and wound about the spool 44. The tether 46 may be attached to the spool 44 by mechanical means or by tying the tether 46 to the spool 44. The tether 46 has a free end 48 extending through the aperture 24. A guide bar 50 retains the tether 46 in alignment with the aperture 24. The tether 46 preferably extends between 8 feet and 12 feet away from the housing 12. It is preferred that the tether 46 has a test weight of at least 800 lbs. A fastening assembly 52 is attached to the free end 48 for selectively attaching the free end 48 to a dwelling 8. The depicted fastening assembly 52 includes a conventional clamp which may be attached to a wall fixture or even to furniture within the dwelling 8. Alternate fastening assemblies may include a bolt driven into a wall of the dwelling 8 and a fastener for securing the free end to the bolt. However, any conventional fastening assembly may be used.

In use, a person climbs through a window of a dwelling 8 which is on fire. The person places their hands 9 on the gripping members 30 and then the gripping members 30 are rotated such that the hands 9 are secured within the housing 12 by a compressing action between the gripping members 30 and the front wall 20. Also, a pair of loop members 54, shown only in FIG. 2, may be attached to the front wall 20 such that they hang downwardly therefrom. If the loop members 54 are used, the person extends their arms through the loop members 54 before gripping the gripping members 30. The person jumps out of the window and is suspended by the device 10. Because the gravitational force of the person's body rotates the upper side 34 toward the front wall 20, the hands 9 cannot be removed until person is lifted upwardly, presumably by a firefighter on a ladder.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire escape device for suspending a person from a dwelling, said device comprising:

a housing having a top wall, a first end wall, a second end wall, a front wall and a rear wall, said top wall having an aperture extending therethrough;

a spindle being rotatably mounted to and extending between said first and second end walls;

a pair of gripping members being attached to spindle, said gripping members being spaced from each other, each of said gripping members having a bottom side, an upper side, a pair of lateral sides, a forward side and a back side, said spindle extending through each of said lateral sides such that said bottom sides are positioned nearer said spindle than said upper sides and said gripping members are aligned with each other;

a spool being rotatably mounted on said spindle and being positioned between said gripping members;

a tether being attached to and wound about said spool, said tether having a free end extending through said aperture;

a fastening assembly being attached to said free end for selectively attaching said free end to the dwelling; and wherein each of a pair of hands may be positioned on said gripping members and said gripping members rotated such that the hands are secured within the housing by a compressing action between the gripping member and the front wall.

2. The device of claim 1, wherein said top wall is arcuate such that a cross-section of said housing taken transversely to a longitudinal axis of said housing has an upside down U-shape.

3. The device of claim 1, wherein each of said front and rear walls having a flared bottom edge.

4. The device of claim 2, wherein a first distance is defined between said top wall and said upper sides when said upper sides are directed toward said top wall and a second distance is defined between said front wall and said upper sides when said upper sides are directed toward said front walls, said second distance being less than ½ inch, said first distance being greater than said second distance.

5. The device of claim 4, wherein said upper sides are convexly arcuate from said forward sides to said back sides.

6. The device of claim 5, wherein each of said upper sides having a plurality of aligned finger receiving indentations therein extending between said lateral sides.

7. The device of claim 2, wherein said upper sides are convexly arcuate from said forward sides to said back sides.

8. The device of claim 7, wherein each of said upper sides having a plurality of aligned finger receiving indentations therein extending between said lateral sides.

9. The device of claim 1, wherein each of said upper sides having a plurality of aligned finger receiving indentations therein extending between said lateral sides.

10. The device of claim 1, further including a pair of loop members being attached to said front wall and hanging downwardly therefrom.

11. The device of claim 4, further including a pair of loop members being attached to said front wall and hanging downwardly therefrom.

12. A fire escape device for suspending a person from a dwelling, said device comprising:

a housing having a top wall, a first end wall, a second end wall, a front wall and a rear wall, said top wall having an aperture extending therethrough, said top wall being arcuate such that a cross-section of said housing taken transversely to a longitudinal axis of said housing has an upside down U-shape, each of said front and rear walls having a flared bottom edge;

a spindle being rotatably mounted to and extending between said first and second end walls;

a pair of gripping members being attached to said spindle, said gripping members being spaced from each other, each of said gripping members having a bottom side, an upper side, a pair of lateral sides, a forward side and a back side, each of said forward and back sides of said gripping members being substantially planar and being parallel orientated with respect to each other, said spindle extending through each of said lateral sides such that said bottom sides are positioned nearer said spindle than said upper sides and said gripping members are aligned with each other, a first distance being defined between said top wall and said upper sides when said upper sides are directed toward said top wall, a second distance being defined between said front wall and said upper sides when said upper sides are directed toward said front walls, said second distance being less than ½ inch, said first distance being greater than said second distance, said upper sides being convexly arcuate from said forward sides to said back sides, each of said upper sides having a plurality of aligned finger receiving indentations therein extending between said lateral sides;

a spool being rotatably mounted on said spindle and being positioned between said gripping members;

a tether being attached to and wound about said spool, said tether having a free end extending through said aperture;

a fastening assembly being attached to said free end for selectively attaching said free end to the dwelling; and wherein each of a pair of hands may be positioned on said gripping members and said gripping members rotated such that the hands are secured within the housing by a compressing action between the gripping member and the front wall.

* * * * *